United States Patent [19]

Graham et al.

[11] 4,218,502

[45] Aug. 19, 1980

[54] INTUMESCABLE FIRE-RETARDANT PRODUCTS

[75] Inventors: Joseph Graham, Oakdale, Minn.; James R. Lodge, deceased, late of Little Canada, Minn., by Jean I. Lodge, personal representative

[73] Assignee: Minnesota Mining and Manufacturing Company, St. Paul, Minn.

[21] Appl. No.: 916,941

[22] Filed: Jun. 19, 1978

[51] Int. Cl.[2] ..... B32B 5/16; B32B 11/02; B32B 9/00

[52] U.S. Cl. ..... 428/144; 428/149; 428/325; 428/331; 428/404; 428/921; 521/122

[58] Field of Search ..... 428/143, 144, 145, 149, 428/323, 325, 331, 404, 406, 920, 921, 306, 308; 260/42.24; 521/122; 528/48

[56] References Cited

U.S. PATENT DOCUMENTS

| | | | |
|---|---|---|---|
| 1,946,052 | 2/1934 | Baldwin | 106/308 F |
| 2,754,217 | 7/1956 | Allen et al. | 106/15 FP |
| 2,782,129 | 2/1957 | Donegan | 428/331 |
| 2,927,045 | 3/1960 | Lodge et al. | 428/405 |
| 2,940,942 | 6/1960 | Hodnefield | 252/8.1 |
| 3,365,322 | 1/1968 | Hinds | 428/921 |
| 3,455,850 | 7/1969 | Saunders | 106/15 FP |
| 3,561,999 | 2/1971 | Iannicelli | 106/308 F |
| 3,619,264 | 11/1971 | Worms et al. | 427/220 |
| 3,707,385 | 12/1972 | Kraemer et al. | 106/15 FP |
| 3,855,741 | 12/1974 | Semon | 52/232 |
| 3,924,032 | 12/1975 | Hertl | 427/220 |
| 4,015,031 | 3/1977 | Reinhardt et al. | 427/220 |
| 4,107,376 | 8/1978 | Ishikawa | 428/403 |

FOREIGN PATENT DOCUMENTS

| | | | |
|---|---|---|---|
| 721467 | 1/1955 | United Kingdom | 427/220 |

*Primary Examiner*—William J. Van Balen
*Attorney, Agent, or Firm*—Cruzan Alexander; Donald M. Sell; Roger R. Tamte

[57] ABSTRACT

Asphalt roofing material is made fire-retardant by inclusion of a layer of intumescable hydrated soluble silicate particles. Preferred soluble silicate particles carry a protective moisture-resistant coating which increases the life of the roofing material, and also makes possible convenient manufacture of the particles. The protective coating includes a metal cation capable of reacting with the silicate ion of the core particle to form a reaction product that is less soluble than the core particle. The reaction is believed to seal any openings in the protective coating, thereby lengthening the effective life of the coating. Besides utility in roofing materials, the coated particles are useful as fire-retardant additives in many other products, including polymeric articles, sheet materials, coating compositions, etc.

34 Claims, 3 Drawing Figures

INTUMESCABLE FIRE-RETARDANT PRODUCTS

BACKGROUND OF THE INVENTION

Despite many efforts over the years, there has never been a fire-retardant asphalt roofing material having the same widespread acceptance as standard, non-fire-retardant versions.

The prior efforts have taken several directions: use of mineral fibers as a filler in the asphalt layers or as a replacement fiber in the roofing felt for the purposes of reducing combustible material and limiting flow and exposure of asphalt during a fire (see Fasold et al, U.S. Pat. No. 2,555,401; Tomlinson et al, U.S. Pat. No. 3,332,830; and Schuetz, U.S. Pat. No. 3,369,956); inclusion of chemical fire-retardant agents in the roofing (see Tomlinson and Bierly, U.S. Pat. No. 2,667,425); and/or use of extra or heavier layers of roofing granules. Some of these approaches have produced commercial roofing sufficiently fire-retardant to be rated Class A by Underwriter's Laboratory (in contrast to the Class C rating of standard asphalt roofing); but even those approaches are not the answer the art is seeking, since they either greatly increase the cost of roofing, require special manufacturing equipment or processes, or provide only marginal fire protection. As an example of the latter deficiency, some commercial roofing materials with glass fiber felts pass Underwriter's Laboratory's "burning brand" test on ½-inch-thick (2 centimeters-thick) roof decks, but they will not pass the test on ⅜-inch-thick (1-centimeter-thick) roof decks, which are now approved for use in construction.

A different approach tried by several prior workers is to introduce a layer of intumescable particles into the roofing, which, as stated in Donegan, U.S. Pat. No. 2,782,129, is intended to expand in the presence of a fire to form "a fire resistant support or rigid sponge which adsorbs the asphalt, preventing flow and providing an effective fire barrier to the underlying roof." Donegan suggests use of unexpanded vermiculite as the intumescable material, disposed as a particulate layer between two layers of asbestos-filled asphalt. Bick et al, U.S. Pat. No. 3,216,883, also suggests the use of vermiculite, either unexpanded or partially expanded, in "built-up" roofing (formed in place on a roof). Hinds, U.S. Pat. No. 3,365,322 (1968), cites disadvantages of vermiculite (it is expensive and, because of its low weight, is difficult to incorporate into roofing in uniform amounts), and suggests replacing the vermiculite with mineral granules that carry an intumescable coating of sodium silicate and borax.

None of these efforts with intumescable roofing have been as effective as some of the other described approaches. Roofing material as taught in Hinds was commerically sold for awhile, but without apparent success. Very little intumescence was provided by the coated granules, and fire-resistance appeared to depend on presence of asbestos fibers as a filler in the asphalt; such a filled asphalt is difficult to apply by standard coating equipment, is costly, and has toxicity and other disadvantages. In addition, the coated mineral granules were flood-coated into the roofing material at weights of 100 to 125 kilograms per 10-by-10-meter section of applied roofing, adding to cost and weight of the roofing. Also, the coating on the granules was soluble in water, and in the nearly continuous flood-coated layer was especially susceptible to leaching and consequent loss of intumescability.

Vermiculite as suggested by Donegan and Bick also offers only low-volume intumescence; and vermiculite will not intumesce until a fire has progressed sufficiently to create high temperatures.

In brief, nothing in the known prior work with intumescable roofing suggests that intumescence could be the basis for an effective and economical fire-retardant asphalt roofing.

SUMMARY OF THE INVENTION

The present invention provides a new roofing material, which is of the intumescable type, but which offers an economic and effective fire-retardancy that promises widespread utility for the roofing material. In basic construction, the new roofing material can be like previous intumescable roofing materials, i.e. it generally comprises a roofing felt; at least one asphalt coating above the felt; a layer of roofing granules partially embedded in the top asphalt coating on the roofing felt; and a layer of intumescable particles disposed within the roofing material so as to intumesce when the roofing material is exposed to fire. Also, the intumescable material in the new roofing material is hydrated soluble silicate, which, as indicated above, has previously been used in fire-retardant roofing as a coating on mineral granules.

Notwithstanding such similarities, roofing material of the invention is effective where prior-art intumescable roofing has not been. A first difference over prior-art intumescable roofing is that the intumescable particles in roofing material of the invention comprise hydrated soluble silicate at their core, rather than in a peripheral coating as in Hinds' silicate-coated mineral granules. Despite previous work in the art with hydrated soluble silicate, there has never, so far as known, been a commercially available hydrated soluble silicate in particulate form such as used in roofing material of the invention, nor has such particulate hydrated soluble silicate been suggested as an intumescable fire-retardant additive. We have succeeded in providing a commercially practicable method of manufacture of such particles (as will be subsequently described), and have found that when the particles are included as a layer in roofing material, they provide a fire-retardancy far superior to that provided in any previous intumescable roofing.

Another reason for the superior intumescence of roofing material of the invention is the protection given the hydrated soluble silicate glass particles against attack by moisture. Moisture will leach away alkali metal oxide from soluble silicate particles and take away their ability to intumesce. Some protection against such attack can be provided with extra-heavy layers of asphalt, extra-high concentrations of intumescable particles, or constructions in which the particles are sandwiched between impermeable films. The effectiveness of these procedures is assisted by the concentrated nature of the intumescable particles used in the present invention; since each individual intumescable particle in roofing material of the invention intumesces in large volume, fewer particles need be used and the particles can be better surrounded and isolated by moisture-resistant structure.

However, the present invention achieves even more effective moisture-protection with a novel hydrated soluble silicate particle that carries a unique protective coating. This protective coating includes an ingredient that is ionized in the presence of water to provide metal cation capable of reacting with the silicate ion of the core particle. The reaction between the metal and silicate ions forms a reaction product that is less water-soluble than the core particle, whereby a protective layer is formed around the particle. The protective coating is regarded as having a self-healing function, in that any openings which develop in the protective layer tend to be sealed, thereby limiting action of water on the core particles and maintaining the intumescent character of the particles.

The protective coating is also a key to convenient manufacture of the intumescable particles. Prior to the present invention, the art might have considered two general kinds of method for manufacturing hydrated soluble silicate particles: drying of commercially available solutions of soluble silicates to a solid of the needed water content; and hydration of commercially available anhydrous soluble silicate material. Both methods present difficulties: the drying operation of the first method forms a film that retards evaporation and greatly lengthens the process; and the hydration step in the second method tends to form agglomerated glass-like material that is difficult to comminute to needed sizes. Such difficulties have now been overcome with the discovery that anhydrous soluble silicate material, crushed to a desired particle size, can be coated with the described protective coating and then hydrated to the desired moisture content under the heat and pressure of an autoclave, producing ready-to-use non-agglomerated particles.

In a different manufacturing method, anhydrous soluble silicate fines can be agglomerated to desired particle sizes with liquid soluble silicate, coated with the described protective coating, and heated to form intumescable hydrated soluble silicate particles (the heating operation is understood as distributing water present in the liquid soluble silicate throughout the particle to make the particle intumescable). Particles formed from agglomerated fines have the advantage that during intumescence they tend to form a multicellular product, which has greater crush strength.

A less desirable alternative for manufacturing particles useful in the invention is to hydrate uncoated anhydrous soluble silicate particles in a bed of inert particles such as clay. A protective coating of the invention can be applied to particles that have already been hydrated, as well as to anhydrous particles.

Because of the moisture-resistant nature of coated particles of the invention, together with their small size and high degree of intumescence, they can be conveniently and economically included in asphalt roofing materials without significant change of standard manufacturing procedures. A rather low amount of the particles can be applied per unit area of the roofing material, and the particles can be cascaded directly onto and partially embedded in asphalt coatings already incorporated into standard asphalt roofing materials.

The amount of intumescence exhibited by roofing material of the invention can be controlled through selection of the amount of intumescable particles. A rather low amount of particles gives the roofing material a large volume of intumescence and a high degree of fire-retardancy. Roofing material of the invention passes Underwriter's Laboratory's "burning brand" test on either 2-centimeter or 1-centimeter-thick decks, and in fact, will pass a more stringent laboratory test in which a Bunsen burner is trained continuously for 30 minutes on a 15-by-15-centimeter sample of applied roofing material (i.e. overlapped in the manner that roofing shingles are applied to a roof deck), but laid over a piece of unsaturated organic felt paper rather than a roof deck. In neither test does fire penetrate through the test sample.

Further, extended tests of roofing material of the invention at restricted test sites as well as accelerated aging tests indicate that the described fire-retardancy is retained over a useful lifetime for roofing. The total combination of properties is a significant advance in the roofing material art, and appears to offer for the first time the potential for asphalt-saturated, felt-based roofing material to be offered in a form that is both highly fire-retardant and economical.

Besides use in roofing material, coated particles of the invention can be included in a wide range of materials—ranging from solid foams to liquid coating compositions. The moisture-resistance and highly intumescent character of the particles make their use convenient and effective, all at moderate cost.

Additional Prior Art

According to Vail, J. G., *Soluble Silicates* (1952, Reinhold Publishing Company), Volume 2, page 481, the United States patent literature on intumescence of soluble silicates begins in 1883 with Kelly, U.S. Pat. No. 283,789, which teaches a cellular mass of expanded silicate as a thermal insulation for fireproof safes. Arthur, U.S. Pat. No. 1,041,565, issued in 1912, teaches a particulate soluble silicate such as sodium or potassium silicate which may be intumesced to form expanded or cellular particulate material useful as thermal insulation.

The patent literature very early discusses ways to insolubilize the soluble silicate glasses. Gesner, U.S. Pat. No. 419,657, issued in 1890, teaches the treatment of cellular silicate glasses with chemical agents such as calcium chloride; acids such as sulfuric or hydrochloric acid; and soluble oxides and salts of metals other than alkaline metals, including such oxides as barium or strontium hydroxide and such salts as calcium or barium nitrite. Gesner also teaches that the cellular material may be made impervious to water by coating it with paraffin, drying oils, asphalt, rubber and fused or dissolved insoluble metallic soaps or oleates or stearates, and solutions of resins or gums.

The Hinds patent mentioned above suggests that the intumescable coated granules may be coated with asphalt emulsions, oils, silicones, or latex emulsions to prevent water-absorption by the granules.

Another example of prior teachings as to use of intumescable silicate materials for fire retardancy is Vail's report (page 483) that wooden beams have been coated with heavy silicate solutions to reduce the hazard of fire.

In a different kind of teaching, Cohen, U.S. Pat. No. 917,543 suggests the use of sodium silicate in roofing material as an adhesive to bond a sheet of asbestos to a sheet of organic fibers and form a fire and waterproof material. However, there is no suggestion that the sodium silicate be particulate or intumescable as in the case in our new roofing material.

Insofar as known, nothing in the prior art teaches asphalt-saturated, felt-based roofing material containing a layer of hydrated soluble silicate particles for fire-retardancy. Nor does the known prior art teach particulate silicate glasses, not yet expanded but still intumescable, and coated with a coating that protects and increases the expansibility of the particles during intumescence and makes possible their convenient manufacture.

DETAILED DESCRIPTION

Sodium silicates are preferred as the soluble silicate glass in intumescable particles of the invention because of their lower costs, but silicates formed from other alkali metals may also be used, including, for example, those formed from potassium and lithium. The silicates used may also have different ratios of silica to alkali-metal oxide, but silicates having a ratio above about 2 to 1 are preferred because they are less water-soluble than those of lesser ratios.

The intumescable particles can range widely in size, though as shown in Table I, volume of intumescence varies with the size of the particles.

Table I

Volume Intumescence of Sodium Silicate Particles ($SiO_2$; $Na_2O$ ratio of 3.22, and hydrated with 13 percent water)

| Particle Size | | Volume to which two-milliliter sample expands |
|---|---|---|
| Range of size (micrometers) | Average diameter (micrometers) | (milliliters) |
| 200–2380 | 2200 | 200 |
| 840–2000 | 1400 | 200 |
| 590–840 | 710 | 175 |
| 420–590 | 500 | 175 |
| 297–420 | 350 | 160 |
| 176–297 | 230 | 125 |
| 125–176 | 150 | 110 |
| 88–127 | 105 | 90 |
| 70–88 | 80 | 80 |
| 62–74 | 67 | 70 |
| 44–62 | 53 | 50 |
| ~40 | 28 | 25 |
| ~20 | 14 | 3 |
| ~10 | 6 | 3 |

As the particle size reported in the table rises above minimal values, the volume of intumescence increases significantly; the reported particles that average approximately 25 micrometers in size intumesce over ten-fold, and the reported particles that average approximately 100 micrometers, intumesce over forty-fold. Particles of the invention should intumesce at least four-fold and preferably at least forty-fold for most uses as a fire-retardant additive. For the highest volume-percent of intumescence, particles above about 300 micrometers in diameter are preferably used (in giving values for maximum and minimum diameter, the values stated apply for only 90 volume-percent of the particles, since after a screening operation some of the remaining particles are outside the screen sizes). For the most satisfactory use in roofing material the particles should average less than 2 millimeters, and preferably less than 1 millimeter in diameter. However, particles up to several centimeters in diameter can also be used for special purposes.

Figure 3:
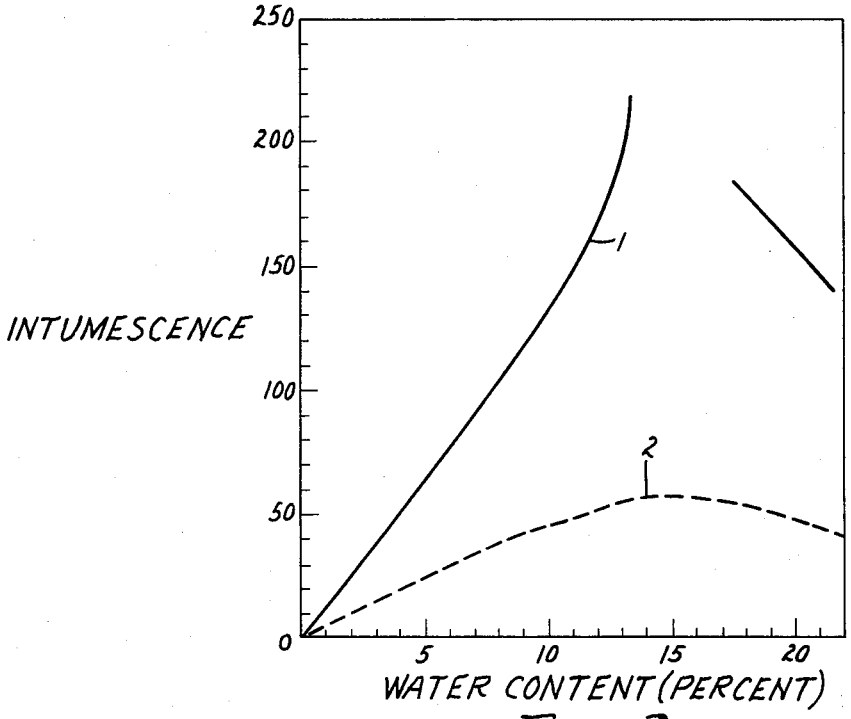
FIG. 3 is a graph showing the amount of intumescence versus water content for coated particles of the invention and particles that are the same except for being uncoated.

The particles will intumesce in different amounts depending on the amount of water present. Curve 1 in FIG. 3 is a graph of the intumescence at a typical actuating temperature range (i.e., about 200° to 300° C.) for coated sodium silicate particles generally of the type described in Example 1 below, but with varying water content, and Curve 2 is a similar curve for uncoated particles. (The curves show the volume in milliliters to which a 2-milliliter sample expands.)

To obtain a useful amount of intumescence the soluble silicate should generally include at least 3 percent, and preferably at least 10 percent, water. Peak intumescence for the illustrated sodium silicate occurs at around 15 percent water. With greater amounts of water beyond 15 percent, intumescence declines, though it will occur for contents of water up to, and in fact beyond, the point (about 30 percent) at which the soluble silicate dissolves in water. Typically, no significant benefits are obtained by including more than 20 percent water.

Whereas the core particle in coated particles of the invention can be quite soluble in water, the protective coating comprises ingredients that have a low solubility, preferably a room-temperature solubility in water of less than 0.2 gram/cubic centimeter. However, even with this low solubility, there is sufficient dissociation to provide metal cations for self-healing reaction with silicate ion of the core particle.

The preferred protective coating, providing the longest-lasting and most thorough moisture protection, comprises a metal salt of a long-chain fatty acid. Stearic acid is the preferred long-chain fatty acid but others, such as oleic or palmitic acid, can also be used. Also, although calcium is a preferred metal, other metals, such as the alkaline-earth metals barium and magnesium, and aluminum and zinc, can be used.

In preferred coatings as just described, the best water-stability has been obtained when the coating includes metal, in an ionizable compound, in excess of that needed for stoichiometric association with the anion of the long-chain fatty acid. The excess metal of such metal-cation-rich coatings can be provided, for example, as the hydroxide, carbonate, chloride, or fluoride of the metal. Typically the excess-metal-providing ionizable compound, which is desirably present in an amount accounting for at least one-half volume-percent of the protective coating, is more soluble than the metal salt of the long-chain fatty acid.

Other water-insoluble components can be included in protective coatings of the invention, either as a supplement or as a substitute for the metal salt of a long-chain fatty acid. For example, organic polymeric films such as polyethylene, polypropylene, wax, epoxy resins, or urethane resins may be used. An ionizable ingredient providing metal cation for reaction with silicate ion of the core particle should be included in such coatings to obtain the best water-stability.

A further ingredient preferably included in protective coatings on particles of the invention is silicone water-repellent agents. A large list of such agents are known to repel moisture from a surface on which they are applied. Use of such a repellent coating has been found to add significantly to the moisture-resistance provided by the protective coating.

The long-term stability of coated particles of the invention has been demonstrated both in extended aging tests on test decks, and by accelerated laboratory tests in which the particles are totally immersed in water and their intumescability measured at various intervals. In the latter kind of testing, for example, sodium silicate particles as described in Example 1 below, after having been immersed in water for 40 days, still exhibit useful intumescence upon heating. When sodium silicate particles the same as those of Example 1, but without any protective coating, are subjected to the same test, they will not intumesce at all after 1–3 days of exposure. Also, when sodium silicate particles the same as those of Example 1 except coated with calcium stearate in which the calcium and stearate are in stoichiometric proportions are subjected to the same testing, intumescence of the particles declines after 6 to 9 days to the level exhibited by particles of Example 1 after 40 days of exposure.

The protective coating on coated particles can be applied by known coating procedures. For example, the core particles can be mixed with the coating material while the latter is in a liquid form, e.g. by melting or dissolving. The coating is then allowed to harden to a substantially continuous film, as by cooling, drying or reacting. In one useful coating operation, the core particles are first coated with a liquefiable portion of the coating—e.g. melted stearic acid; oleic acid, which is liquid at room temperature; molten polymer such as polyethylene; or a liquid uncured epoxy resin-hardener composition. Then, before the coating has cooled or hardened, other ingredients such as the metal-cation-supplying ingredient are added, as by mixing a powdered form of that ingredient and the coated core particles. For example, powdered calcium hydroxide is conveniently mixed with particles that have been first coated with molten stearic acid. After such mixing, the calcium hydroxide becomes partially embedded in the stearic acid coating; the calcium reacts with the stearic acid to form nearly insoluble calcium stearate; and any unreacted calcium hydroxide remains present in the layer to provide excess calcium cation for a self-healing function.

Metal-cation-supplying ingredient such as calcium hydroxide can also be incorporated into other ingredients of the protective coating, such as stearic acid, prior to coating the core particles. For calcium hydroxide and stearic acid, calcium stearate is produced during such a premixing operation and must be melted before the core particles can be coated.

Coated particles of the invention can generally be included in an amount of no more than about 50, and more commonly are included in an amount of no more than about 25, kilograms per 10-by-10-meter section of applied roofing material. At least 5, and preferably at least 10, kilograms of particles are generally used per 10-by-10-meter section. Though generally embedded in an asphalt coating on the roofing felt, the layer of particles may be disposed elsewhere in the roofing material, e.g., in the felt itself, which is generally a fibrous sheet material made from organic and/or mineral fibers. Felts filled with particles of the invention may also be used as a fire-retardant underlayment under shingles, either as a supplement to or substitute for fire-retardant shingles.

Besides utility in roofing material, coated particles of the invention are also useful as fire-retardant additives in a variety of other articles, including rigid or flexible foams, molded or sheet articles, extruded or cast films, elastomeric articles, etc. Such articles may be made from polyurethanes, epoxy resins, polyesters, etc. Also, the particles can be introduced into various coating materials to form fire-retardant coatings; such coating materials generally comprise a liquid vehicle that hardens to a solid coating upon exposure as a thin coating in predetermined environments. Also, the particles can be added in a loose mixture with other powdered materials for fire-retardant purposes. In addition to protecting a substrate against fire, particles of the invention can perform a heat insulating function; for example, a coating containing a layer of particles of the invention can be used to protect steel beams from reaching temperatures during a fire that would damage the beams and cause them to sag. Also, particles of the invention can be intumesced and used for a variety of purposes; for example, particles can be intumesced at a building site and introduced into the walls or other structure of the building as thermal insulation.

The invention will be further illustrated by the following examples.

EXAMPLE 1

One-hundred parts of anhydrous sodium silicate glass particles having a $SiO_2$:$Na_2O$ ratio of 3.22 and a range in size from about 300 to 840 micrometers were heated in an oven to 250° F. (120° C.). After reaching that temperature, the particles were dumped into a cement mixer and 2 parts of powdered stearic acid added, whereupon the stearic acid melted and became coated on the particles. After the mixing had continued for about 10 minutes, 2 parts of calcium hydroxide was added and the mixing continued for an additional 10 minutes. Next, 1 part of a silicone water repellent (DC-772 sodium siliconate from Dow Corning) was added and mixed in for 10 minutes.

The coated particles were discharged into trays to a bed depth of about 5 centimeters. The trays were loosely fitted with aluminum foil lids and placed in an autoclave where they were hydrated at a steam temperature of 285° F. (140° C.) for 2 hours. After removal from the autoclave the particles were free-flowing, had a water content of 10 weight-percent, and expanded upon heating about 65 fold. Intumescence was measured by gradually pouring 2-milliliter-size samples into an aluminum pan heated by a hot plate to a temperature above 400° F. (205° C.), whereupon the particles immediately intumesced. The intumescent particles were then gathered and their volume measured in a graduated cylinder.

Figure 1:
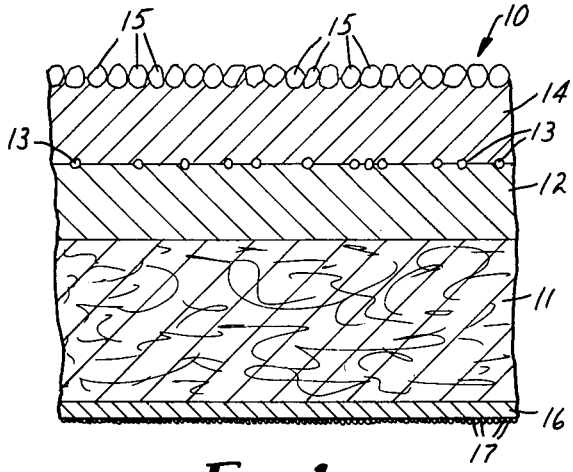
FIG. 1 is a sectional view through an illustrative roofing material 10 of the invention. The roofing material 10 can be made as follows: A roofing felt paper 11 is saturated, and coated on its top surface to form a layer 12, with an asphaltic composition. Intumescable soluble silicate particles 13 are cascaded onto the coated felt where they become partially embedded in the layer 12. A layer 14 of asphaltic composition is then applied over the particles of the invention; and roofing granules 15 are cascaded onto the layer 14, where they become partially embedded. A back coating 16 of asphaltic composition is applied to the bottom of the felt paper 11, and a dust coating 17 of mica or the like is applied to make the back side of the material tack-free.
Figure 2:
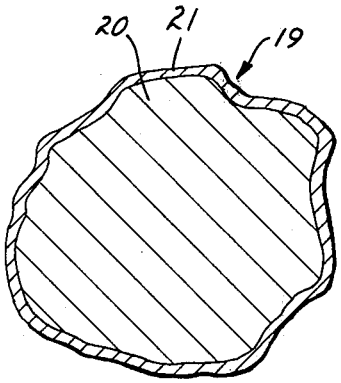
FIG. 2 is a sectional view through a representative intumescent particle 19 of the invention, which comprises a core particle 20 and a protective coating 21 surrounding the particle.

Particles of the example were incorporated into a standard roofing material in the manner shown in FIG. 1. The weight amount of the various layers was as follows: layer 12, 100 kilograms; layer 13, 15 kilograms; and layer 14, 300 kilograms per 10-by-10-meter section of applied roofing. When the resulting roofing material was tested by the "burning brand" and more stringent laboratory tests noted above, the fire did not burn through the test samples.

Samples of the described roofing material were placed on roof decks in restricted test sites for five years, and when removed from the deck showed no visible change and again passed the noted "burning brand" and more stringent laboratory tests.

EXAMPLE 2

Example 1 was repeated in a larger batch size with a rotary autoclave. Instead of 2 parts of calcium hydroxide, 20 parts were used. The larger amount formed a thicker coating on the particles and made them more free-flowing without reducing intumescence.

EXAMPLE 3

Example 1 was repeated except the silicone water-repellent agent was omitted. When the resulting particles were tested in the described accelerated aging test, they exhibited useful intumescence after a 20-day exposure.

EXAMPLES 4 and 5

Example 3 was repeated except that the stearic acid was replaced with either oleic acid (Example 3) or palmitic acid (Example 4). In the accelerated aging test the calcium-oleate-treated particles had a useful life of 6 days in water, and the calcium-palminate-treated particles of 7 days.

EXAMPLES 6–8

Example 3 was repeated with sodium silicate particles except that the calcium hydroxide was replaced with either aluminum hydroxide (Example 6), magnesium hydroxide (Example 7), or barium hydroxide (Example 8). In the accelerated aging test, the aluminum-stearate-treated particles had a life of 6 days, and the barium-stearate-treated particles of 9 days.

EXAMPLES 9 and 10

Example 3 was repeated except that the sodium silicate particles were replaced in Example 9 with lithium silicate ($SiO_2$:$K_2O$ ratio of 2.50) and in Example 10 with potassium silicate ($SiO_2$:$K_2O$ ratio of 2.50). Upon heating to about 200° C., the particles intumesced manyfold.

EXAMPLE 11

Example 3 was repeated except that 2 parts of polyethylene low-density polyethylene powder replaced the stearic acid, and 2 parts of calcium hydroxide were used. In the accelerated aging test the coated particles had a life of 6 days.

EXAMPLE 12

Sixty parts of particles of Example 3 were mixed into 100 parts of a mixture of Parts A and B of precursors (available from Freeman Chemical Corporation, Port Washington, Wis.) that form a pour-in-place, rigid urethane foam having a density of about 0.032 gram per cubic centimeter. The mixture was poured into trays and allowed to cure. After removal from the trays, the cured samples were conditioned according to the specifications outlined in Underwriter's Laboratory's tests for flammability of plastic materials, and then subjected to the horizontal burning test for classifying materials (Test No. 94 HBF) and the vertical burning test for classifying materials (Test No. 94 VE-O). In each test the samples passed the test.

EXAMPLE 13

Ten parts of particles of Example 3 were mixed into a mixture of 100 parts polyol (TP740 commercially available from Wyandotte Chemical Corporation) and 55 parts of polyisocyanate (Mondur MRS commercially available from Mobay). The mixture was then catalyzed by adding 0.3 part lead octoate. Samples were cured and conditioned according to the specifications outlined in Underwriter's Laboratory's tests for flammability of plastic materials, and then subjected to the horizontal burning test for classifying materials (Test No. 94 HBF) and the vertical test for classifying materials (Test No. 94 VE-O). In each test the samples passed the test.

EXAMPLE 14

Uncoated sodium silicate particles ($SiO_2$:$Na_2O$ ratio of 3.22) ranging between 300 and 840 micrometers in diameter and hydrated with a water content of about 14 percent were incorporated into roofing material as shown in FIG. 1. Weights were as listed for the roofing material described in Example 1, except that the layer of intumescent particles 13 weighed 100 kilograms per 10-by-10-meter section of applied roofing. After exposure of a test deck for 3 years, the roofing material still exhibited useful intumescence when exposed to a fire.

EXAMPLE 15

One-hundred-sixty parts of anhydrous sodium silicate fines having a $SiO_2$:$Na_2O$ ratio of 3.22 and a particle size smaller than about 300 micrometers were mixed in a Hobart mixer with 40 parts of liquid sodium silicate having a silica-to-soda ratio of 3.22 and a water content of about 62 percent. Agglomerated particles were formed and screened to leave particles in a size range of 300 to 840 micrometers. The particles were coated in the manner described in Example 1 with 2 parts stearic acid and 5 parts calcium hydroxide, and then heated in an oven for about 4 hours. The resulting particles intumesced about 50-fold when heated to 300° C.

Alternatively, the particles can be prepared by coating the core particles only with calcium hydroxide and no stearic acid, although the particles are not as free-flowing during the hydrating operation.

What is claimed is:

1. Fire-retardant, intumescable roofing material comprising in parallel layers, a roofing felt; at least one asphalt coating disposed above the felt; a layer of roofing granules partially embedded in the top asphalt coating in the roofing material; and a layer of intumescable particles disposed within the roofing material and comprising, in at least a 25-micrometer-diameter core, hydrated soluble silicate glass which intumesces when heated to 300° or less.

2. Roofing material of claim 1 in which said layer of intumescable particles weighs between 5 and 50 kilograms per 10-by-10-meter section of applied roofing.

3. Roofing material of claim 1 in which said layer of intumescable particles weighs less than 25 kilograms per 10-by-10-meter section of applied roofing.

4. Roofing material of claim 1 in which at least 90 volume-percent of said intumescable particles are between about 0.1 and 2 millimeters in diameter.

5. Roofing material of claim 1 in which said intumescable particles comprise sodium silicate having a silica-to-soda ratio of greater than 2 to 1.

6. Roofing material of claim 1 in which said intumescable particles carry a protective moisture-resistant coating, which includes an ingredient that is ionized in the presence of water to provide metal cation capable of reacting with the silicate ion of the core particle to form a reaction product less water-soluble than the silicate glass of the core particle, thereby limiting action of water on the core particle.

7. Roofing material of claim 6 in which the protective coating comprises a metal salt of a long-chain fatty acid.

8. Roofing material of claim 7 in which the protective coating further includes metal cation in excess of that required for stoichiometric association in said salt.

9. Moisture-resistant particles that intumesce in large volume when exposed to heat comprising a core particle that comprises a hydrated soluble silicate glass, and a protective moisture-resistant coating surrounding the core particle; the protective coating including an ingredient that is ionized in the presence of water to provide metal cation capable of reacting with the silicate ion of the core particle to form a reaction product that is less water soluble than the silicate glass of the particle, thereby limiting action of water on the core particle.

10. Particles of claim 9 in which at least 90 volume-percent of the core particles are between about 0.1 and 2 millimeters in diameter.

11. Particles of claim 9 in which said core particle comprises smaller soluble silicate particles bonded together.

12. Particles of claim 9 in which the hydrated soluble silicate glass comprises hydrated sodium silicate glass.

13. Particles of claim 12 in which the ratio of silica to soda in the sodium silicate is more than 2 to 1.

14. Particles of claim 9 in which the protective coating comprises a metal salt of a long-chain fatty acid.

15. Particles of claim 13 in which the protective coating further includes metal cation in excess of that required for stoichiometric association in said salt.

16. Particles of claim 14 in which said long-chain fatty acid comprises stearic acid.

17. Particles of claim 14 in which the metal of said metal salt comprises calcium.

18. Particles of claim 9 in which the protective coating further includes a silicone water-repellent agent.

19. Coating material comprising a liquid vehicle and particles of claim 9 dispersed in the liquid vehicle.

20. Sheet material in which particles of claim 9 are dispersed.

21. Foamed insulating material in which particles of claim 9 are dispersed.

22. Polyurethane elastomer in which particles of claim 9 are dispersed.

23. Moisture-resistant particles that intumesce in large volume when exposed to heat comprising core particles, at least 90 volume-percent of which are between about 0.1 and 2 millimeters in diameter, which comprise hydrated sodium silicate glass having a silica-to-soda ratio of at least 2 to 1, and which are capable of intumescing at least forty-fold upon heating to about 300° C.; and a moisture-resistant protective coating surrounding the core particle and comprising a metal cation capable of reacting with the silicate ion of the core particle to form a reaction product less water-soluble than the silicate glass of the core particle, thereby limiting action of water on the core particle.

24. Particles of claim 23 in which the protective coating comprises a metal salt of a long-chain fatty acid.

25. Particles of claim 24 in which the metal of said metal salt comprises calcium.

26. Particles of claim 23 in which the protective coating further includes a silicone water-repellent agent.

27. Particles of claim 23 in which the core particle comprises smaller particles of sodium silicate bonded together.

28. Roofing material comprising a roofing felt; at least one asphalt coating above the felt; a layer of roofing granules partially embedded in the top one of said asphalt coatings; and a layer of particles of claim 23 disposed within the roofing material.

29. Roofing material of claim 28 in which the particles account for less than 25 kilograms per 10-by-10-meter section of applied roofing material.

30. Coating material comprising a liquid vehicle and particles of claim 23 dispersed in the liquid vehicle.

31. Sheet material in which particles of claim 23 are dispersed.

32. Foamed insulating material in which particles of claim 23 are dispersed.

33. Polyurethane elastomer in which particles of claim 23 are dispersed.

34. Fire-retardant, intumescable roofing material comprising in parallel layers, a roofing felt; at least one asphalt coating disposed above the felt; a layer of roofing granules partially embedded in the top asphalt coating in the roofing material; and a layer of intumescable particles disposed within the roofing material in an amount of 15 kilograms or less per 10-by-10-meter section of applied roofing and comprising, in at least a 25-micrometer-diameter core, hydrated soluble silicate glass which intumesces at least 10-fold when heated to 300° C.

* * * * *

UNITED STATES PATENT AND TRADEMARK OFFICE

CERTIFICATE OF CORRECTION

PATENT NO. : 4,218,502

DATED : August 19, 1980

INVENTOR(S) : Joseph Graham and James R. Lodge

It is certified that error appears in the above–identified patent and that said Letters Patent are hereby corrected as shown below:

In column 1, after the title, but before the heading "Background of the Invention," please insert as follows:

--Reference to Related Application

This application is a continuation-in-part of application Serial No. 814,493, filed July 11, 1977.--

In column 1, line 30, "1/2" should be --3/4--.

In column 1, line 39, "adsorbs" should be --absorbs--.

In column 5, line 49, "200-2380" should be --2000-2380--.

In column 9, line 23, "3" should be --4-- and in line 24 "4" should be --5--.

In column 9, line 41, "$K_2O$" should be --$Li_2O$--.

In column 10, line 54, "300°" should be --300°C--.

Signed and Sealed this

Twenty-first Day of July 1981

[SEAL]

Attest:

GERALD J. MOSSINGHOFF

Attesting Officer

Commissioner of Patents and Trademarks